United States Patent [19]

Yanabu et al.

[11] Patent Number: 4,458,121

[45] Date of Patent: Jul. 3, 1984

[54] DC CIRCUIT BREAKER

[75] Inventors: Satoru Yanabu, Machida; Tohoru Tamagawa, Chigasaka; Eiji Kaneko; Takumi Funahashi, both of Yokohama, all of Japan

[73] Assignee: Tokyo Shibaura Denki Kabushiki Kaisha, Kanagawa, Japan

[21] Appl. No.: 428,949

[22] Filed: Sep. 30, 1982

[30] Foreign Application Priority Data

Apr. 19, 1982 [JP] Japan ..... 57-65094

[51] Int. Cl.[3] ..... H01H 33/70; H01H 33/59

[52] U.S. Cl. ..... 200/148 R; 200/148 C; 200/150 B; 200/150 D; 200/150 E; 200/144 AP

[58] Field of Search ..... 200/148 R, 148 C, 150 B, 200/150 D, 150 E, 144 AP

[56] References Cited

U.S. PATENT DOCUMENTS

| | | | |
|---|---|---|---|
| 2,227,134 | 12/1940 | Hara | 200/150 B |
| 2,267,399 | 12/1941 | Farrar et al. | 200/144 AP |
| 2,714,645 | 8/1955 | Salzer | 200/150 D |

FOREIGN PATENT DOCUMENTS

| | | | |
|---|---|---|---|
| 857306 | 4/1940 | France | 200/148 C |
| 1272157 | 8/1961 | France | 200/150 B |
| 56-38722 | 4/1981 | Japan . | |

*Primary Examiner*—Robert S. Macon

*Attorney, Agent, or Firm*—Oblon, Fisher, Spivak, McClelland & Maier

[57] ABSTRACT

A DC circuit breaker of the type using a blown arc-extinguishing gas is disclosed which allows for reliable fast interruption of DC currents through the provision of arc extension current paths. The extension current paths are relatively long and are bent after the incidence of the arc-extinguishing gas on the arc. The arc is formed to extend for a long distance in a loop configuration. An auxiliary electrode short-circuits the extended arc with one auxiliary electrode being provided for each extension current path.

9 Claims, 14 Drawing Figures

DC CIRCUIT BREAKER

BACKGROUND OF THE INVENTION

1. Field of the Invention

This invention relates to a DC circuit breaker which uses the blowing of an arc-extinguishing gas onto the arc.

2. Description of the Prior Art

In the case of AC there is a time point during the passage of the current in which the current is instantaneously zero, but in the case of DC there is no such time point. Circuit breaking of DC is therefore not as easy as in the case of AC. However, circuit breaking of DC can be made easier by superimposing AC on the DC, so that the current does have a condition in which it is instantaneously zero, i.e. a current zero point. One example of a development which has been made with this object in view is the connection, in parallel with the pair of electrodes of the circuit breaker, of a series L-C circuit consisting of a coil and a capacitor. The arc onto which the arc-extinguishing gas is blown has a marked negative resistance characteristic so that strong oscillations are generated in the oscillation circuit represented by the series L-C circuit and a progressively increasing oscillation current flows in this circuit. In this condition the arc current is the result of superposition of the DC current which is to be interrupted and the oscillating current. The instantaneous current thus varies in an oscillating manner, with gradually increasing amplitude, about the value of the direct current mentioned above. Ultimately, a time point is reached at which the current flowing between the two electrodes is zero. The DC current passing through the circuit breaker is interrupted at this point.

Although the above method of circuit breaking is effective, the development of a DC circuit breaker is required that can interrupt large currents reliably in a short time and which is of smaller size.

SUMMARY OF THE INVENTION

Accordingly, one object of this invention is to provide a novel DC circuit breaker that can reliably interrupt in a short time DC currents that are larger than can be interrupted by conventional DC circuit breakers of the type in which an arc-extinguishing gas is blown onto the arc.

In order to achieve this object, the DC circuit breaker of this invention, which has a series LC circuit connected in parallel with the two electrodes, is provided with arc extension current paths which extend the arc produced between the two electrodes during circuit breaking, and auxiliary electrodes, in the neighborhood of the first-mentioned electrodes, that automatically short-circuit this extended arc.

The arc extension current paths consist of a plurality of relatively long current paths which are gently bent after the incidence of the arc-extinguishing gas on the arc and which exhaust to the outside, so that an arc is formed which extends for a long distance in these current paths, in a loop configuration. One or more of the auxiliary electrodes are provided for each of the arc extension current paths, in at least the inlet portion thereof, through which the arc is blown into the extension current paths.

Owing to this construction, in a DC circuit breaker according to this invention, when the two electrodes are separated, an arc is produced between the two electrodes, and a progressively increasing oscillating current is generated in an oscillation circuit having the aforementioned arc and series L-C circuit. The arc is blown into the arc extension flow paths by the action of the arc-extinguishing gas, so that this arc successively passes the auxiliary electrodes and extends reciprocating in a loop shape through these arc extension flow paths. The arc voltage between adjacent auxiliary electrodes therefore rises with the result that the adjacent auxiliary electrodes become directly coupled by a short-circuiting arc which does not follow the path of the loop-shaped arc. When this short-circuit arc that practically directly links the auxiliary electrodes without forming the loops between adjacent auxiliary electrodes is generated, it spreads to all of the adjacent auxiliary electrodes. This causes an abrupt fall in the arc voltage between the fixed and movable electrodes, suddenly generating a large oscillating current in the oscillation circuit. When this is superimposed on the DC current that is to be interrupted, the arc current flowing between the fixed electrode and movable electrode executes large oscillations about the value of the said DC current. The zero arc current condition is therefore attained at an earlier stage and more reliably than if arc extension flow paths and auxiliary electrode oscillation circuits are not used. This permits DC current circuit breaking to be achieved more reliably and at an earlier stage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
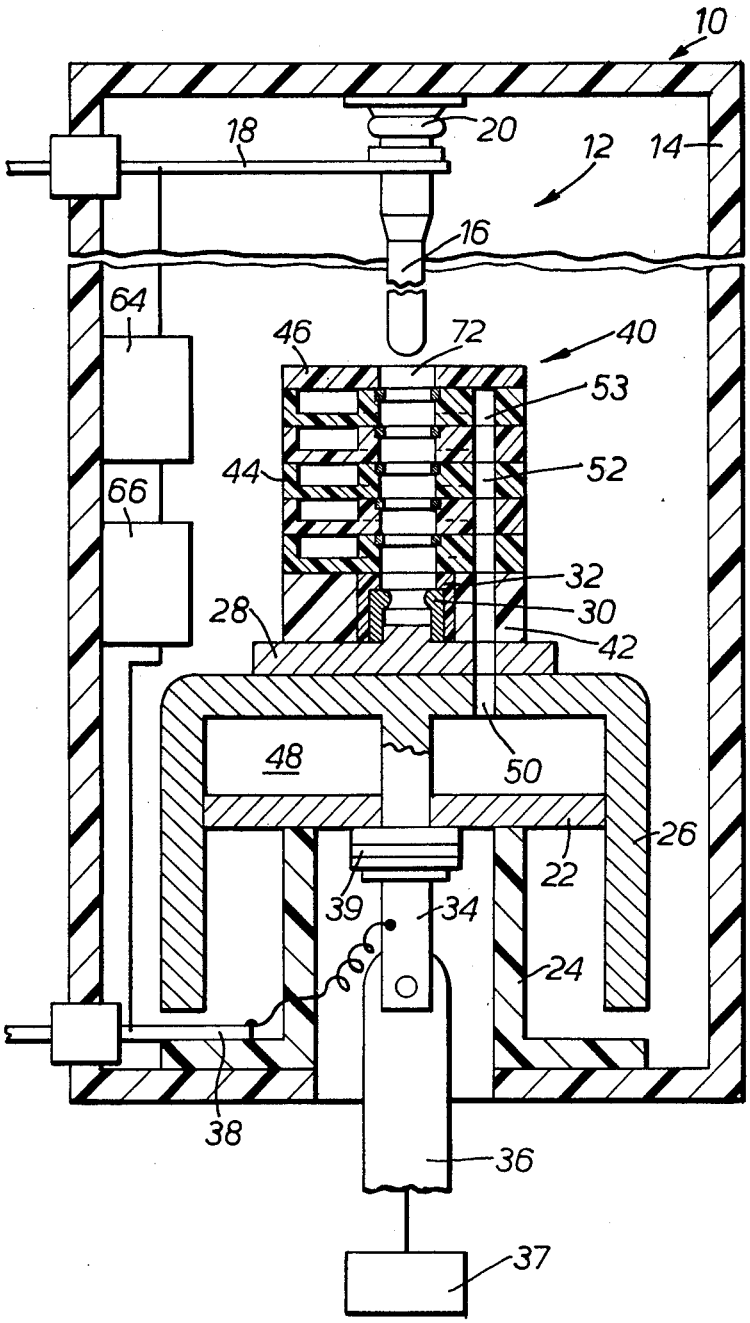
FIG. 1 is an axial view of a DC circuit breaker according to this invention.

Referring now to the drawings, wherein like reference numerals designate identical or corresponding parts throughout the several views, and more particularly to FIG. 1 thereof, there is shown an axial section of a DC circuit breaker 10. The internal mechanism 12 of this DC circuit breaker 10 is received in a pressure vessel 14 filled with an arc-extinguishing gas consisting of compressed air or compressed gas at about 5–15 bar. The fixed electrode 16, together with a high-voltage terminal 18, is mounted inside the pressure vessel 14 by means of an insulating support 20. A puffer piston 22 is mounted inside the pressure vessel 14 by means of an insulating support 24. A movable electrode base 28 is mounted on top of a puffer cylinder 26 that moves vertically in the drawing in cooperation with a puffer piston 22. On this movable electrode base 28 there is fixed a movable electrode 30 and an insulating cover 32, which covers the side surface of the movable eletrode 30, with the cover 32 and the electrode 30 together forming a ring shape. The puffer cylinder 26 is provided with a downwardly extending rod member 34 which extends down through the puffer piston 22 and is connected to a drive device 37 through an electrically insulating operating rod 36. The puffer piston 22 is provided with a low voltage terminal 38 and a current collector 39 that slides with the rod member 34.

Figure 2:
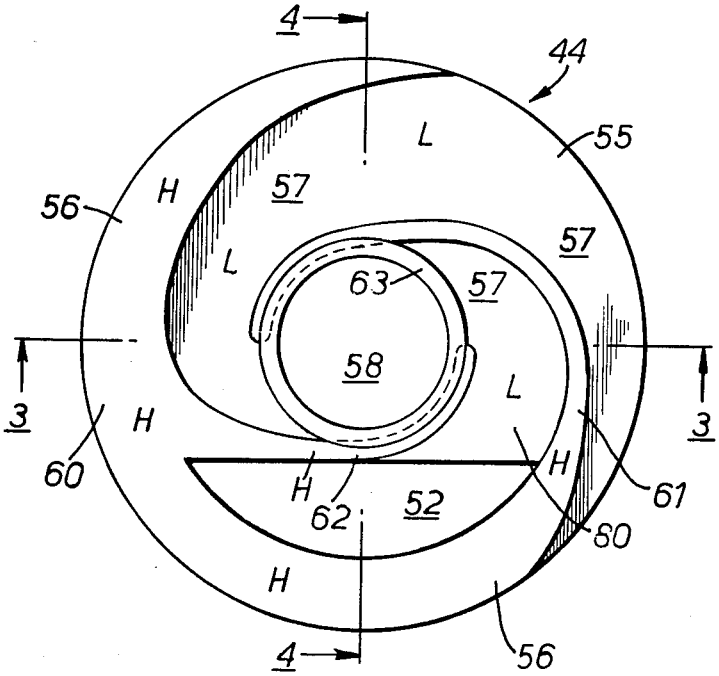
FIG. 2 is a plan view of an arc-extinguishing element used in the DC circuit breaker of FIG. 1.
Figure 3:
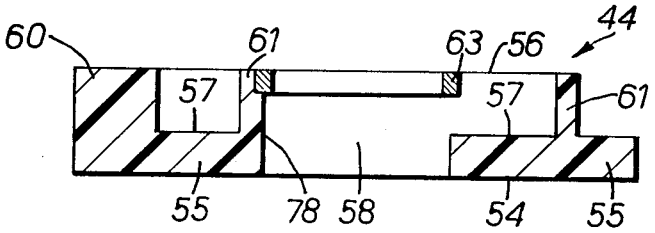
FIG. 3 is a cross section of the arc-extinguishing element of FIG. 2 along the line 3—3.
Figure 4:
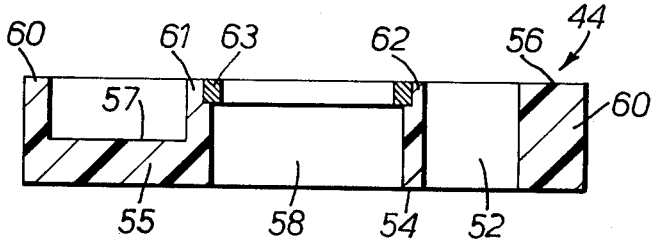
FIG. 4 is a cross section of the arc-extinguishing element along the line 4—4.
Figure 5:
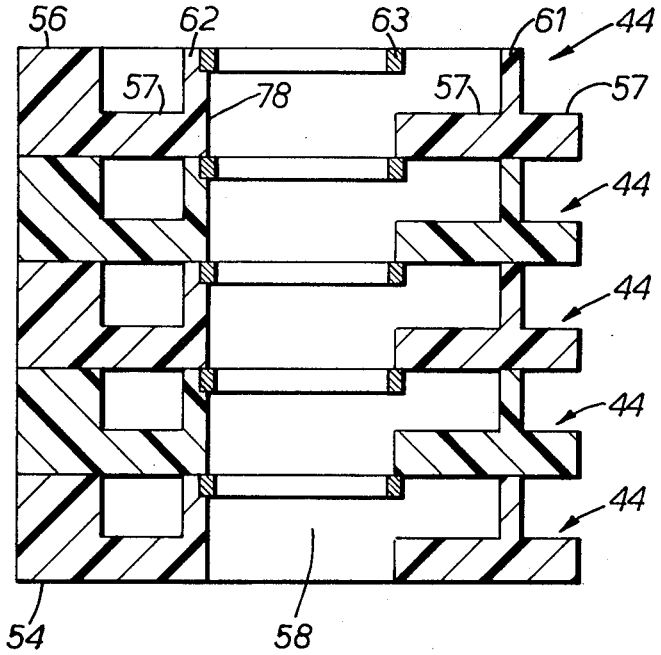
FIG. 5 is a cross-sectional view showing five of the arc-extinguishing elements of FIG. 2 piled on top of each other.

On top of the movable electrode base 28 there is mounted an arc-extinguishing block 40 formed by arranging a base member 42, five practically identically shaped arc-extinguishing elements 44, and a cover plate 46, which are made of electrically insulating material such as ceramics of teflon, the element 44 being one on top of another. The extinguishing gas chamber 48 formed between the puffer piston 22 and puffer cylinder 26 communicates with the chamber 53 consisting of through-holes 52 formed in the five arc-extinguishing elements 44, through through-holes 50 provided in the movable electrode base 28 and base member 42. FIG. 2 is a view from above of one of the arc-extinguishing elements 44. FIG. 3 is a cross section along the line 3—3 of an arc-extinguishing element 44. FIG. 4 is a cross section along the line 4—4 of an arc-extinguishing element 44. As can be seen from FIGS. 2, 3 and 4, the arc-extinguishing element 44 is provided with: a base plate 55; a peripheral wall 60 which extends above the peripheral portion of the said base plate 55 over a prescribed range; and an inner wall 62 and outer wall 61 which run in spiral paths from the middle of the said peripheral wall and from its anticlockwise end, respectively, running round the through-hole 58 for the fixed electrode, in the anticlockwise direction, to the extent of approximately 180°, and reaching that portion of the base plate 55 which is peripheral to the said through-hole 58 for the fixed electrode. One face of the base plate 55 of FIG. 3 and FIG. 4 forms a flat lowermost face 54; its other face forms an inside-bottom face 57 from which the peripheral wall 60, outer wall 61 and inner wall 62 project upwardly. The tops of these walls form an upper surface 56, which is parallel with the lowermost surface 54 and inside-bottom surface 57. The distribution of the upper surface 56, indicated by H, and the inside-bottom surface 57, indicated by M, are shown in FIG. 2. The segmental shape of the cross section of the through-hold 52 can be clearly seen in FIG. 2. The auxiliary electrode 63 is defined coplanar with the upper surface 56 formed by the tops of the outer wall 61 and inner wall 62 of the arc-extinguishing element 44, and concentric with the through-hole 58 for the fixed electrode. FIG. 1 shows five such arc-extinguishing elements 44 in the same sectional plane as FIG. 4, stacked together. FIG. 5 shows the five arc-extinguishing elements piled one upon another sectioned in the same sectional plane as in FIG. 3. As shown in FIG. 1, the five arc-extinguishing elements 44 are clamped between the cover plate 46 and base member 42. However, members 46 and 42 are omitted in FIG. 5.

Figure 6:
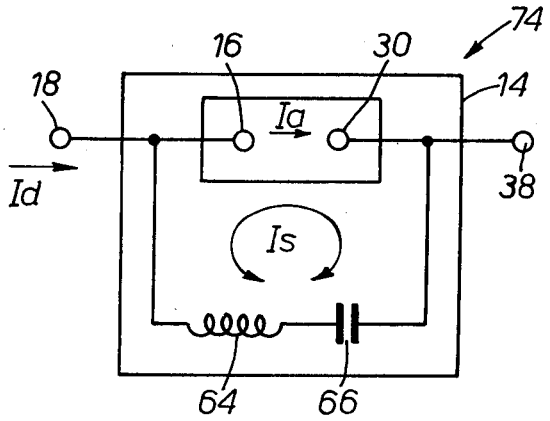
FIG. 6 is a circuit diagram of the oscillation circuit of the DC circuit breaker of FIG. 2.

The reactor 64 and capacitor 66 are mounted in the pressure vessel 14 of the DC circuit breaker 10 of FIG. 1. These members 64 and 66 are connected in series between the high voltage terminal 18 and low voltage terminal 38. This connection is shown in FIG. 6. The symbols used having all been previously explained.

Figure 7:
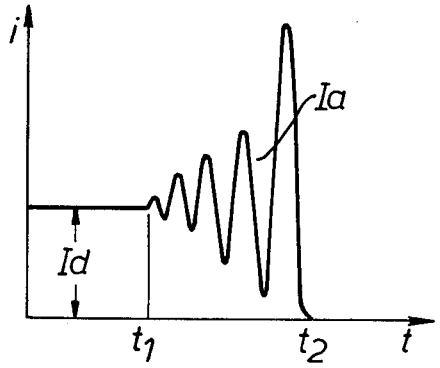
FIG. 7 is a graph showing the time variation of the arc current that flows through the DC circuit breaker of FIG. 2.

The operation of the circuit breaker 10 according to this invention, which has been detailed with reference to FIG. 1–FIG. 6 will now be explained. When the circuit breaker 10 is in a conducting state, the puffer cylinder 26, driven by the operating rod 36, is in its uppermost position, and the fixed electrode 16 is in contact with the movable electrode 30 through the through-hole 58 for the fixed electrode, provided in the hollow insulator 40. The DC current Id which is to be interrupted (see FIG. 7, to be described) flows through the high voltage terminal 18, fixed electrode 16, movable electrode 30, movable electrode base 28, puffer cylinder 26, rod member 34, current collector 39, puffer piston 22, and low voltage terminal 38. In this condition, the chamber 48 which is formed between the puffer piston 22 and the puffer cylinder 26 is in its most enlarged state. The chamber is filled with the compressed gas, that is, the arc-extinguishing gas, that is to be blown onto the arc in circuit-breaking. The voltage applied to the capacitor 66, which is connected between the two terminals 18 and 38, is very small.

When, in a conducting state, the operating rod 36 is pulled downwards, and the movable electrode 30 is separated from the fixed electrode 16, an arc is produced between the two electrodes 30 and 16, with the concurrent generation of an arc voltage between the two electrodes and the appearance of an arc current. With continued downwards movement of the puffer cylinder 26, the arc-extinguishing gas in the chamber 48 passes through the through-hole 50 and flows into the chamber 53 that is formed in the five arc-extinguishing element 44. The arc-extinguishing gas which has flowed into the chamber 53 rises and passes through the through-holes 52 in the direction of the arrow R shown in FIG. 8 in each of the five arc-extinguishing elements. The gas is thus supplied into the through-hole 58 for the fixed electrode, in the anticlockwise direction, through the blast flow path 70 formed between the inner wall 62 and outer wall 61. As a result, it blows the arc (not shown), which runs practically at right angles to the plane of the drawing, in the leftwards direction. The gas is then bent round in spiral fashion in the clockwise direction as it passes the arc extension flow path 88 formed between the outer wall 61 and peripheral wall 60, and is thence exhausted outside the arc-extinguishing elements 44. It is desirable that this spiral arc extension flow path portion should subtend an angle of 90° or more about the through-hole 58.

When the arc is produced, as described above, by separation of the two electrodes 16 and 30, an oscillating current is generated in the oscillation circuit 74 (see FIG. 6) consisting of the resistance across the said arc, the arc, the reactor 64 and the capacitor 66. The arc current Ia is therefore the result of superposition of the DC current Id between the two electrodes 16 and 30 and the oscillating current Is. The electrical oscillations produced in the oscillating circuit become stronger as the two electrodes 16 and 30 separate and as the arc length lengthens, with the result that the arc current and arc voltage vary with progressively greater amplitude. This situation is diagrammatically illustrated in FIG. 7. The horizontal axis of the graph is the time axis and the vertical axis is the current flowing between the two electrodes. Id is the DC current that is to be interrupted and Ia is the arc current. Time point tl is the time at which the oscillating current Is (FIG. 6) is first superimposed on the DC current Id, and may be considered as the time point at which the two electrodes 16 and 30 begin to show a substantial reciprocal action.

Figure 8:
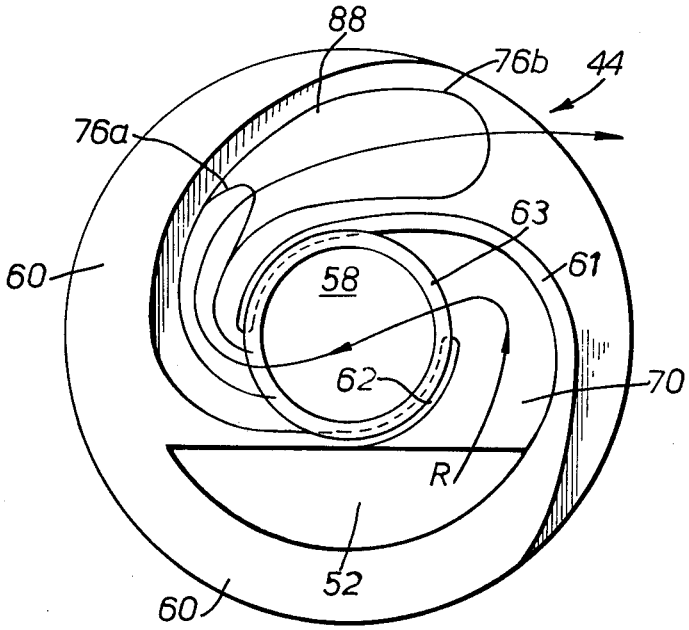
FIG. 8 is a view given in explanation of the shapes of the extended arc and the flow path of the arc-extinguishing gas that flows through the arc-extinguishing elements of FIG. 2.
Figure 9:
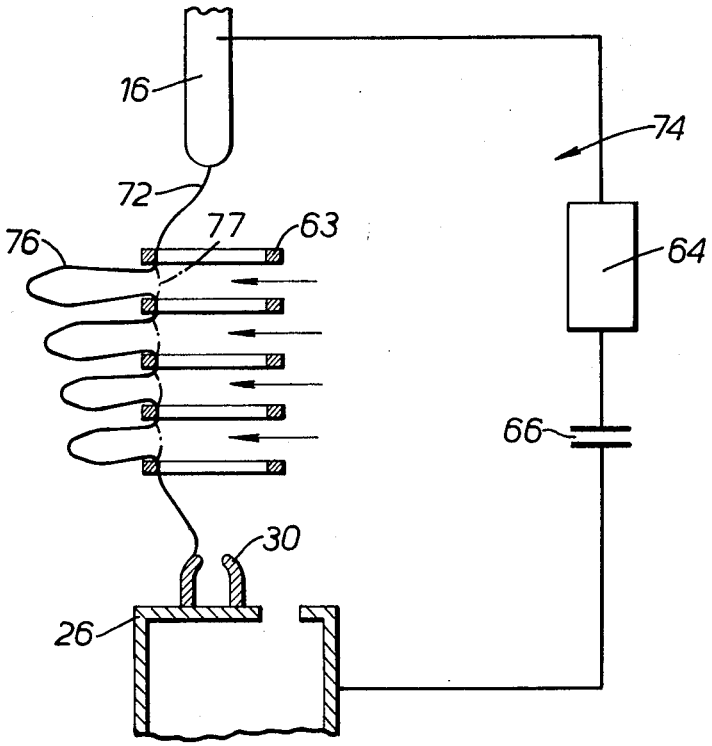
FIG. 9 is a view showing the production of the extended arc between the auxiliary electrode of the arc-extinguishing elements of FIG. 2.

The motion of the puffer cylinder 26 still continues even while the electrical condition is varying as described above. With acceleration of the puffer cylinder 26, the compressed gas in the chamber 48 is supplied with progressively greater force into the chamber 53 through the through-hole 50, and is exhausted to outside the arc-extinguishing elements 44 along the arrow R from the through-hole 52 of the arc-extinguishing elements 44. The arc 72 produced between the fixed electrode 16 and movable electrode 30 is therefore blown into the arc extending flow paths 88 of the respective arc-extinguishing elements 44 to assume a loop shape as shown in FIG. 8 and FIG. 9. Approaching the auxiliary electrode 63 as shown in FIG. 9, the arc 72 that is formed between the two electrodes 16 and 30 is blown into the flow path 88 past the said auxiliary electrode, thus forming extended arcs 76 between the pair of upper and lower auxiliary electrodes 63, respectively. 76*a* in FIG. 8 shows the extended arc when it is still fairly short, at a time point when the voltage across the auxiliary electrode 63 and so the voltage between the two electrodes 16 and 30 are still comparatively small. 76*b* shows the extended arc when it is rather longer, having been more strongly blown into the flow path 70, with the voltage across the auxiliary electrode 63, and therefore between the two electrodes 16 and 30, being higher. As can be seen from FIG. 8, since the arc extension flow paths 88 are spiral-shaped, a long extension of the extended arc 76 can be obtained while using comparatively small arc-extinguishing elements 44, and a strongly oscillating condition can be produced in the oscillation circuit 74. To prevent the drawings becoming excessively complicated, the arc 72 in FIG. 1 is shown by a double-dotted chain line directly connecting the fixed electrode 16 and movable electrode 30. Its actual configuration, with a large number of extended arcs 76 formed between the two electrodes 16 and 30 by the arc-extinguishing gas blast, is shown diagrammatically in FIG. 9.

FIG. 9 is a diagram given in explanation of the rapid extinction of the arc 72 between the electrodes 16 and 30 in the DC circuit breaker of FIG. 1. Only the circuitry necessary for the explanation is shown. FIG. 9 shows how, as the separation between the movable electrode 30 and fixed electrode 16 becomes large, the arc 72 generated between the two electrodes 16 and 30 is pushed, by the arc-extinguishing gas forced out from the chamber 48 (FIG. 1), in the direction of the arrows, to form the extended arcs 76 between respective adjacent pairs of auxiliary electrodes 63. This figure shows the case where there are five arc-extinguishing elements 44 forming the arc-extinguishing block 40 (FIG. 1), and four extended arcs 76 are produced. In the condition of FIG. 9, the movable electrode 30 is at a considerable distance from the fixed electrode 16, so extended arcs 74 are produced between the adjacent auxiliary electrodes 63, making the arc separation between the two electrodes 16 and 30 very long so that the arc has a pronounced negative resistance characteristic, causing a strong oscillating current to flow in the oscillation circuit 74. This results in the oscillating current being increased in a self-excited manner so that with this invention, interruption of the DC current Id, which occurs when the arc current Ia, obtained by superposition of the DC current Id that is to be interrupted and the oscillating current Is becomes zero, is achieved at an earlier stage. As stated above, the reasons for this early interruption is the provision of the arc extension flow paths 88 and the plurality (five in the embodiment) of auxiliary electrodes 63 between the two electrodes 16 and 30 which are arranged comparatively close to each other so that adjacent auxiliary electrodes 63 are easily short-circuited by an arc. Consequently, when the extension of the arcs produced between the auxiliary electrodes 63, due to the effect of the arc-extinguishing gas, causes the arc voltage between these auxiliary electrodes 63 to rise, a short-circuiting arc 77 (FIG. 9), which practically directly couples these auxiliary electrodes 63, is produced. This causes an abrupt decrease in arc voltage between the auxiliary electrodes and an abrupt decrease in arc resistance between these electrodes. This effect extends to all of the adjacent auxiliary electrodes. The result is that the fixed electrode 16 and movable electrode 30 are practically directly short-circuited by this short-circuit arc 77. This causes an abrupt decrease in the arc voltage and arc resistance between the two electrodes 16 and 30. The charge of the capacitor 66, which had hitherto been charged with the higher arc voltage, is therefore suddenly discharged through the two electrodes 16 and 30. This generates a large oscillating current in the oscillation circuit 74. When this oscillating current is superimposed on the DC circuit that is to be interrupted, zero arc current, and therefore DC interruption by the circuit breaker, is rapidly attained. This time point of DC circuit breaking is indicated by t2 on the horizontal axis of FIG. 7.

The arc-extinguishing block 44 described above is only one example and it could be modified in various ways. Examples of such modifications are given below.

Figure 10:
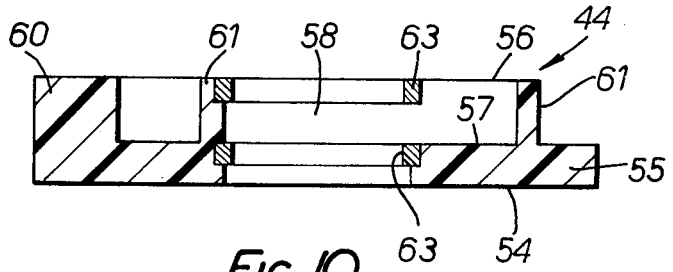
FIG. 10 is a side view showing a modification of the shape of the arc-extinguishing element of FIGS. 2, 3 and 4.

The arc-extinguishing element 44 of FIG. 10 is similar to the arc-extinguishing element described with reference to FIG. 3 and FIG. 4, but differs in that two auxiliary electrodes 63 are provided. Of these auxiliary electrodes, one is arranged coplanar with the uppermost surface 56, as in the case of the arc-extinguishing element of FIG. 3 and FIG. 4, and the other one is arranged coplanar with the inside-bottom surface 57. The reason for this provision of two auxiliary electrodes is severe erosion of the wall portion 78 of the base plate 55 (FIG. 5) which surrounds the through-hole 58 for the fixed electrode, due to the arc coming into contact with it. This drawback can be avoided if, as shown in FIG. 10, two auxiliary electrodes 63 are provided, since the arc is struck between these two auxiliary electrodes 63.

Figure 11:
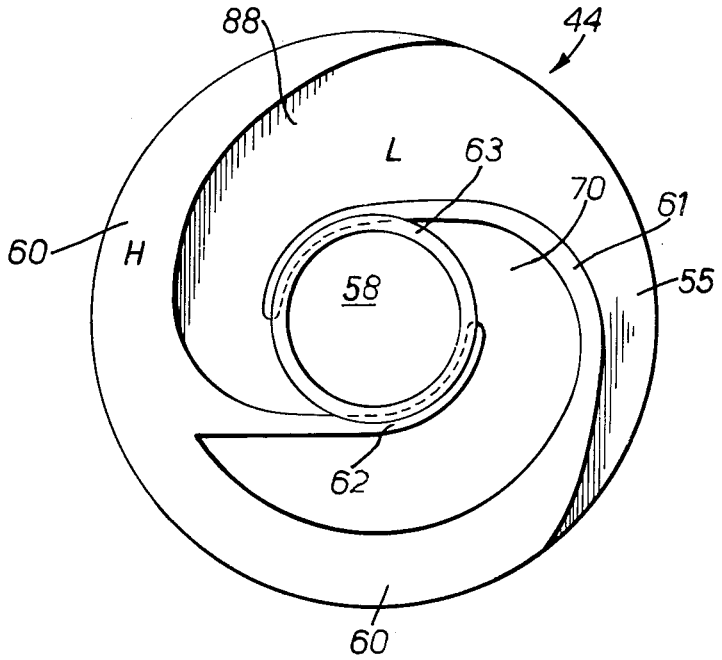
FIG. 11, FIG. 12 and FIG. 13 are views showing other embodiments of the arc-extinguishing element.

FIG. 11 shows another embodiment of an arc-extinguishing element 44 used in the DC circuit-breaker of this invention. Such an arc-extinguishing element 44 is effective in cases where the circuit breaker, and therefore its internal mechanism 12 (FIG. 1), is to be made of small size. In such cases, the cross section of the through-hole 52 is unavoidably smaller, so the arc-extinguishing gas that is forced out from the chamber 48 cannot be blown into the blast flow path 70 with sufficient force. Specifically, in the case of this embodiment, the floor portion 80 that is provided on the inside of the outer wall 61 in FIG. 2 is dispensed with, so the arc-extinguishing gas can enter with little resistance as it can in the case where the through-hole 52 has a large cross-sectional area.

Figure 12:
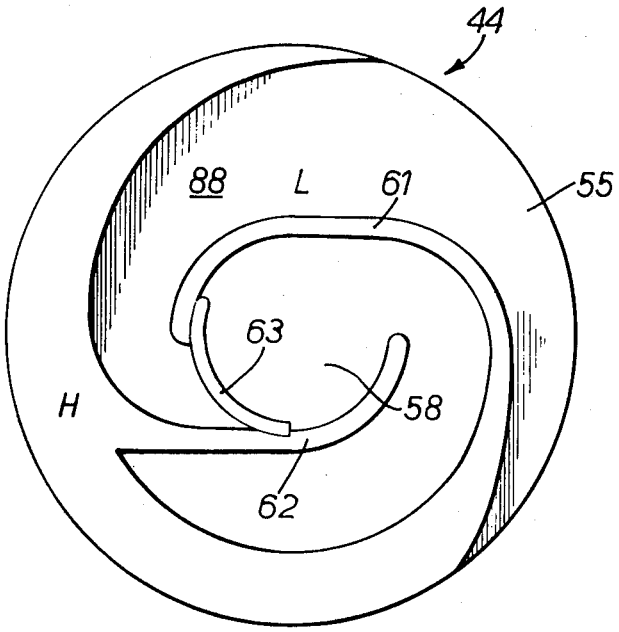

In the case of the arc-extinguishing element 44 shown in FIG. 12, the auxiliary electrode 63 is provided only where the arc extension flow path 88 opens into the through-hole 58 for the fixed electrode and so is formed as part of a ring, i.e. of arcuate shape. This embodiment has the advantage that the resistance of the flow path of the arc-extinguishing gas is reduced, since the auxiliary electrode 63 is only provided on the side where the arc is blown across, i.e. the portion that comes into contact with the arc, so there is no disturbance of flow in the other regions.

Figure 14:
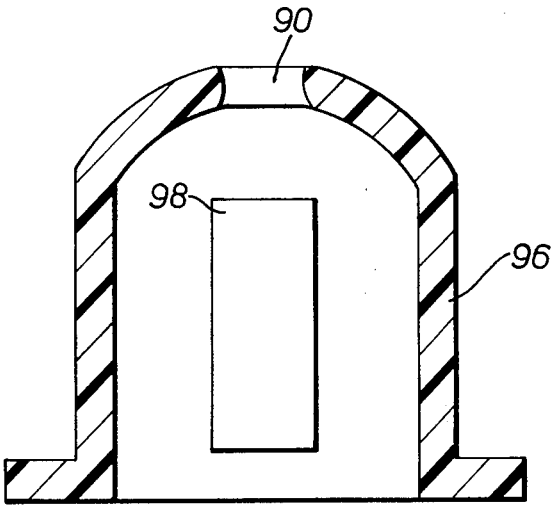
FIG. 14 is a cross-sectional view showing an insulating tube which holds several of the arc-extinguishing elements of FIG. 13 within it stacked upon each other.
Figure 13:
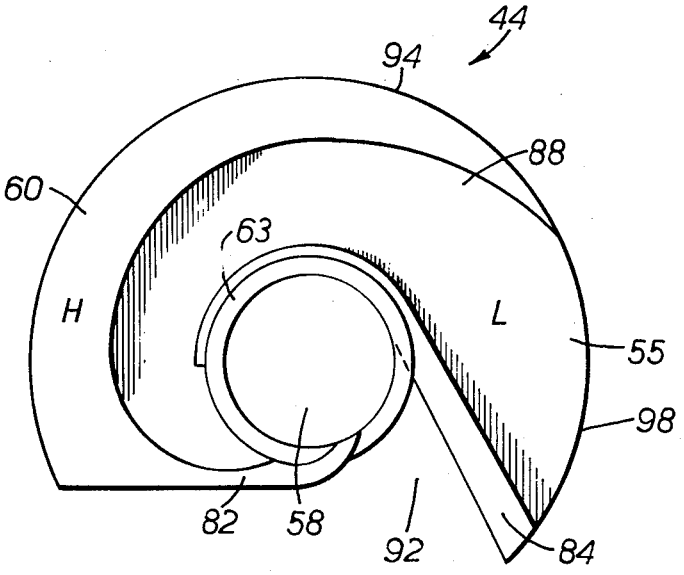

The arc-extinguishing element 44 of FIG. 13 is provided with: a base plate 55 which has at its center a through-hole 58 for the fixed electrode, and which also has a cut-away portion 92 and an arcuate portion 94 at its periphery; a peripheral wall 60 that extends out to approximately the same height from the said base plate 55; and a first wall 82 and second wall 84, an auxiliary electrode 63 being arranged coaxially with the through-hole 58 for the fixed electrode in the region of the extreme ends of these two walls. The first wall 82 and the second wall 84 extend approximately linearly from the two ends of the arcuate portion 94, running in the same sense, until they meet the periphery of the through-hole 58 for the fixed electrode, after which they run round this through-hole for a suitable length. The cut-away portion 92 is formed between the said first wall 82 and second wall 84. The arc-extinguishing gas is delivered directly to this portion and is blown out into the through-hole 58 for the fixed electrode through the opening between this first wall 82 and second wall 84. The peripheral wall 60 extends out from the base plate 55 and runs from the outside end of the first wall 82 along the said arcuate portion 94. The arc extension flow path 88 opens into the through-hole 58 for the fixed electrode through a gap provided between the first wall 82 and second wall 84 and has a spiral configuration in the clockwise direction that widens progressively. This arc extension flow path 88 is particularly effective when a long extended arc is required, since its shape is such that it extends for a long distance along the peripheral wall 60 of the base plate 55. In use, these arc-extinguishing elements 44 are piled up upon each other to form a practically cylindrical insulating tube 96 as shown in FIG. 14. The top of the insulating tube 96 is provided with a through-hole 90 through which the fixed electrode 16 can be inserted or removed, while its side has a practically rectangular window 98. Several arc-extinguishing elements 44 are arranged in the insulting tube 96 coaxially with the said through-hole 90 and with the arc-extinguishing gas discharge ends of their arc extension flow paths 88 lined up in the axial direction and coupled with the said window 98.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A DC circuit breaker comprising:

a fixed electrode and movable electrode that can be moved towards each other or separated from each other;

means for discharging arc-extinguishing gas when the said two electrodes are separated from each other; and means for extinguishing the arc which receives the said arc-extinguishing gas and blows it onto the arc which is formed between the two electrodes, wherein said arc-extinguishing means comprises an oscillation circuit that is connected in parallel with the two electrodes; an arc-extinguishing block which is provided with a through-hole for the fixed electrode arranged between the said two electrodes, through which the fixed electrode can pass to approach or move away from the movable electrode; a blast flow path to guide the arc-extinguishing gas to blow onto the said arc; a plurality of arc extension flow paths opening onto the said through-hole for the fixed electrode whereby the arc-extinguishing gas is exhausted; and wherein at least one auxiliary electrode is mounted in the regions where the said arc extension flow paths respectively open into the through-hole for the fixed electrode.

2. The DC circuit breaker according to claim 1, wherein said arc-extinguishing block comprises:

a plurality of arc-extinguishing elements which are piled on top of each other facing the same way, and which elements are each provided with a base plate which has the said through-hole for the fixed electrode and with wall portions which extend to practically the same height from said base plate;

a cover plate which is piled on top of the said arc-extinguishing elements so as to form a unit; and a through-hole whereby arc-extinguishing gas is introduced; wherein said wall portions comprise a peripheral wall that runs along the periphery of the said base plate and extends above it over a prescribed range of length; an outer wall starting from one end of the said peripheral wall, that runs round approximately half the circumference of the said through-hole for the fixed electrode, in the direction moving away from the said peripheral wall, which reaches the portion of the said base plate that faces the said through-hole for the fixed electrode, and which forms an arc extension flow path between itself and the said peripheral wall that communicates with the through-hole for the fixed electrode; and an inner wall that starts from approximately the middle of the said peripheral wall and that runs approximately half-way round, in the same sense as the said outer wall, that reaches the portion of the said base plate that faces the through-hole for the fixed electrode, and that forms a blast flow path for arc-extinguishing gas between itself and the said outer wall, which path communicates with the through-hole for the fixed electrode;

wherein said cover plate is mounted on the side of the piled-up arc-extinguishing elements on which the wall portions are provided and an aperture is provided in the said blast flow path, whereby the said arc-extinguishing gas is introduced.

3. The DC circuit breaker according to claim 2, wherein said arc extension flow path bends, expanding in spiral fashion, from the through-hole for the fixed electrode towards the periphery of the arc-extinguishing block.

4. The DC circuit breaker according to claim 3, wherein the spiral configuration of said arc extension flow path extends over a range of 90° or more as seen from the central axis of the through-hole for said fixed electrode.

5. The DC circuit breaker according to claim 3, wherein said through-hole whereby the arc-extinguishing gas is introduced into the arc-extinguishing block is provided by the through-holes formed in the base plates of the said arc-extinguishing elements.

6. The DC circuit breaker according to claim 3, characterized in that the through-hole whereby the arc-extinguishing gas is introduced is provided in a portion of the said base plate that faces the blast flow path formed between the inner wall and the outer wall.

7. The DC circuit breaker according to claim 2, wherein said arc-extinguishing block is provided with a plurality of arc-extinguishing elements, which comprise a base plate which has in its center a through-hole for the fixed electrode and whose outer periphery has a cut-away portion and arcuate portion; a peripheral wall which extends from said base plate to practically the same height; first and second walls; and an auxiliary electrode mounted practically coaxially with the through-hole for the fixed electrode, in the region at the ends of these said two walls; and with an insulating tube that receives the said arc-extinguishing elements, wherein said first and second walls extend approximately linearly in the same sense from both ends of the said arcuate portion until they meet the periphery of the through-hole for the fixed electrode, whereupon they run round this through-hole for a prescribed length, wherein said cut-away portion is formed between the first wall and the second wall and arc-extinguishing gas is directly delivered into this portion to be blown into the through-hole for the fixed electrode through an opening between the first and second walls, wherein said peripheral wall extends from the base plate, running from the outside end of the first wall 82 along the said arcuate portion of the base plate, an arc extension flow path being formed between its inner periphery and the second wall, which path opens into the through-hole for the fixed electrode through a gap provided between the first wall and the second wall, and which path has a progressively widening spiral shape in the clockwise direction, and wherein said insulating tube is formed with a rectangular window in its side, a space which receives the arc-extinguishing gas being formed between the inside surface of the said insulating tube and the said cut-away portions, so that the gas is exhausted through this rectangular window.

8. The DC circuit breaker according to claim 1, wherein said auxiliary electrode has the shape of a ring that is arranged coaxially with the through-hole for the fixed electrode.

9. The DC circuit breaker according to claim 1, wherein said auxiliary electrode consists of part of a ring that is coaxial with the through-hole for the fixed electrode.

* * * * *